US006295770B1

(12) United States Patent
Sheu et al.

(10) Patent No.: US 6,295,770 B1
(45) Date of Patent: Oct. 2, 2001

(54) STEEL FRAME BUILDING STRUCTURE

(76) Inventors: Chyi Sheu; Sin-Yuan Lu, both of P.O. Box 90, Tainan City (TW)

( * ) Notice: Subject to any disclaimer, the term of this patent is extended or adjusted under 35 U.S.C. 154(b) by 0 days.

(21) Appl. No.: 09/474,259

(22) Filed: Dec. 29, 1999

(51) Int. Cl.[7] ..... E04H 9/02

(52) U.S. Cl. ..... 52/167.1; 52/633; 52/649.3; 52/649.2; 52/649.1; 52/251

(58) Field of Search ..... 52/251, 256, 259, 52/260, 737.4, 731.7, 633, 649.2, 649.1, 649.3, 167.1

(56) References Cited

U.S. PATENT DOCUMENTS 3,967,426 * 7/1976 Ault et al. ..... 52/252
5,528,876 * 6/1996 Lu ..... 52/654.1
6,023,902 * 2/2000 So ..... 52/649.1

* cited by examiner

*Primary Examiner*—Carl D. Friedman
*Assistant Examiner*—Dennis L. Dorsey

(57) ABSTRACT

A steel frame building structure includes steel posts, steel beams fixed with connect members, and connectors connected to the connect members with bolts and nuts, support frames of wall structures fixed with the beams to construct wall structures, and the wall structures connected tightly with the sides of steel bar nets of an upper and a lower floor by means of fix steel bars. The posts and the beams have their support frames directly assembled with connect members, and the support frames have reinforcing steel bars lateral and vertical in the interior. Holed plates are fixed on outer surfaces of the support frames of the wall structures and the support frames of the posts and the beams, and sealed with sealing means. Then concrete can be placed through openings into hollow spaces in the whole structure with fastness and forming the steel frame building having a strong structure to resist earthquakes.

12 Claims, 12 Drawing Sheets

STEEL FRAME BUILDING STRUCTURE

BACKGROUND OF THE INVENTION

1. Field of the Invention

This invention relates to a steel frame building structure, particularly to one including steel posts, steel beams fixed with connect members, and connectors connected to the connect members with bolts and nuts, then support frames of wall structures fixed with the steel beams to construct wall structures, then the wall structures connected tightly with the sides of steel bar nets of an upper and a lower floor by means of fix steel bars with two ends bent up or assembled with connect members with bolts and nuts, and the support frames have reinforcing steel bars lateral and vertical in the interior. Holed plates are fixed on outer surfaces of the support frames of the wall structures and the support frames of the steel posts and the steel beams, and sealed with sealing means. Then concrete can be placed through openings into hollow spaces in the whole structure with fastness and forming the steel frame building having a strong structure to resist earthquakes.

2. Description of the Related Art

Conventional reinforced concrete buildings or steel frame buildings are shown in FIG. 1, generally consisting of an upper and a lower beam 10 and concrete forms A are fixed between the two beams 10 by binding steel wires and nails, and concrete 11 is placed in hollow space formed by two pairs of two opposite concrete forms A. Then after the concrete hardens, the concrete forms A are taken off for constructing reinforced concrete buildings.

However, the conventional reinforced concrete buildings have the following disadvantages.

1. In performing construction of reinforced concrete, arranging steel bars in concrete is rather difficult, and steel bars are not easy to connect with the beams, often they have to rely on concrete constriction to obtain enduring force against stress. So their assemblage is not reliable and may cause safety problems for the whole building.

2. Concrete forms are not easy to combined with one another during construction, and miscellaneous matters or small bits of items that get in nail fixing and binding steel wires may mix in concrete to worsen its quality. In addition, water and electric tubes are liable to be damaged in drilling holes in concrete forms, causing water leak at a later time, and hardened concrete has to be removed to repair the leak.

3. As space between steel bars and concrete forms is very narrow, it is not easy to pat or pound down concrete, so air bubbles in placing concrete may form bee hive condition in concrete if workers are careless in patting or pounding. Then this bee hive condition may affect the quality of a building.

4. During the construction constructing process, as wall posts are rather high and large, it is not easy to bore an opening in concrete forms (a regular one) for placing concrete, water floating may result after concrete is placed in, with concrete shrunk after hardened, affecting its quality.

5. In constructing process, it includes steel beams, steel bars, concrete forms, and concrete placing, needing many work points and many workers to cause difficulty in arranging work processes and in management, hardly ensuring constructing quality.

6. In constructing process, storing steel material and concrete forms needs a large space, maybe obstructing passage of workers at the site, impeding progress of constructing work and increasing load of management of the work site.

7. In constructing process, concrete forms are made to make space for placing concrete, but wood forms are liable to erode, of short service life, only used temporarily, having no gains in strengthening the whole structure. Thus A wastes material resources and wooden forests.

8. The principle theory of the reinforced concrete building lies in enduring exterior forces against a building by means of steel frames and concrete combined as integral. But if concrete does not constrict steel frames in good condition, cracks may easily occur in concrete, or steel frames may be deficient, not having enough strength to resist earthquakes or shocks. Then materials may disfigure and rupture or rift, and water tubes or electric tubes may be broken to cause water leak and power outage.

9. Tubular routes (PVC plastic tubes) inside walls may crack owing to thin walls at their two sides, earthquakes or strong sunlight, causing water flowing inside rooms.

SUMMARY OF THE INVENTION

A main objective of the invention is to quickly assemble wall structures between an upper and a lower beam or an outer side of a steel frame building structure for combine holed plates, and placing concrete inside the holed plates. Then the whole structure of the building is stable and tough enough to resist earthquakes. When wall structure is formed at the outside of the upper and the lower beams, the weight of the wall structure is endured partly by the whole structure to lighten the load of the wall.

Another objective of the invention is to offer an auxiliary structure for surrounding each corner of each steel post and each steel beam and holes plates are fixed around the auxiliary structure to placing concrete therein to strengthen the steel posts and the steel beams to enhance earthquake resisting force.

The main feature of the invention includes steel frame structures consisting of steel posts and steel beams and plural connect members fixed on the steel posts and the steel beams. It includes the plural auxiliary structures surrounding each corner of each steel post and each steel beam and consisting of support frame channels and reinforcing steel bars. Some support frame-channels have flow holes for concrete in their surfaces. It further includes floor steel structures laid on the upper surfaces of the steel beams and consisting of floor plates and steel bar nets crossing each other. Plural connectors are also included, connected with the steel posts and the steel beams, having threaded holes in a side to combine with the connect members of the steel beams. The wall structure is connected with the connect members of the steel beams with the connectors. Further, holed plates are fixed to surround steel structures of the steel frame structure, used as substitutes of concrete forms.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
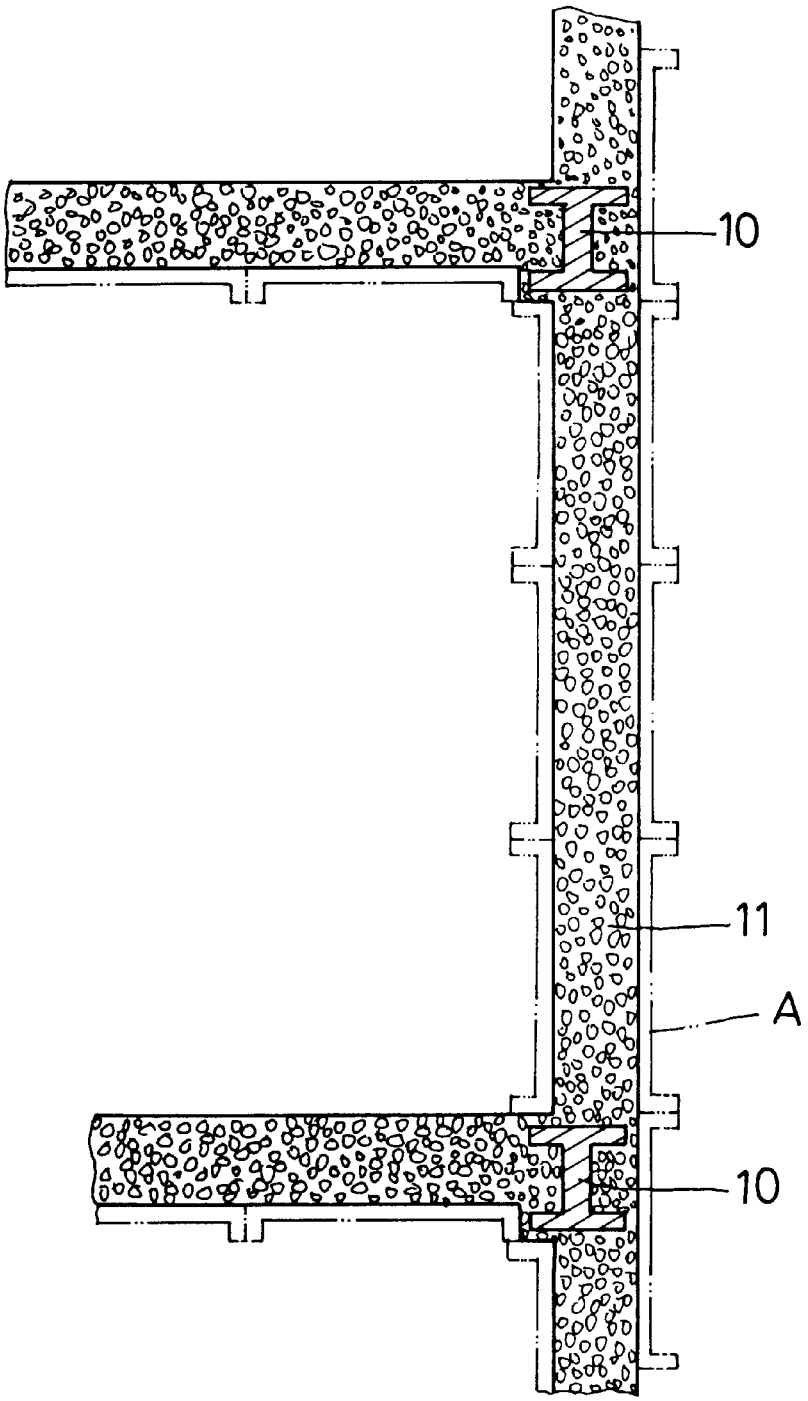
FIG. 1 (PRIOR ART)
FIG. 1 is a cross-sectional view of a conventional structure of reinforcing concrete building.
Figure 2:
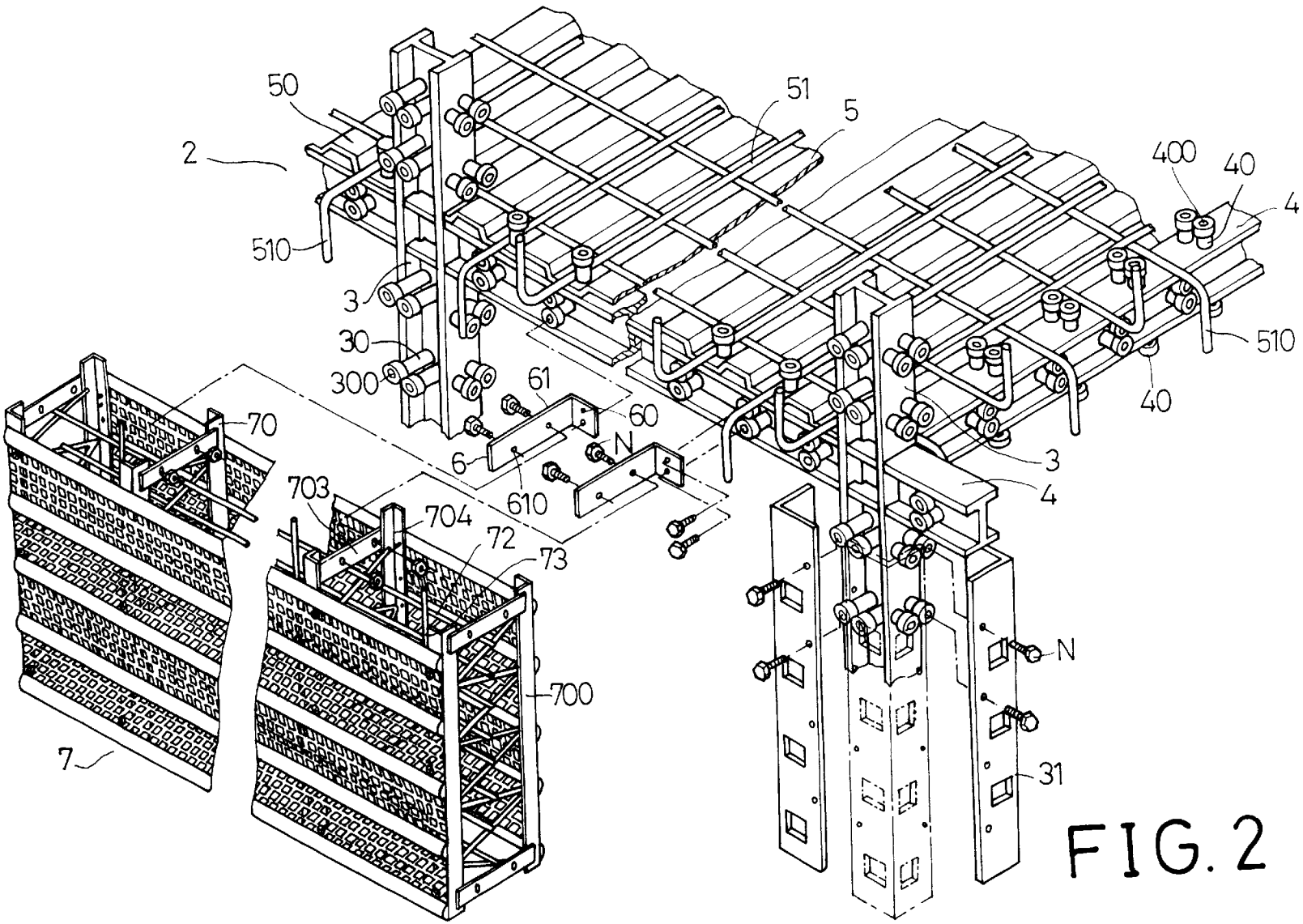
FIG. 2 is an exploded perspective view of a steel frame building structure in the present invention.

A preferred embodiment of a steel frame building in the present invention, as shown in FIG. 2, includes a steel frame structure 2 consisting of steel posts 3, steel beams 4, plural connecting members 30, 40 fixed on their surfaces. Each connecting member 30, 40 has an inner end welded with the surface of a steel post 3 or a steel beam 4, and an outer end formed as a connecting part 300, 400 to connect to other connecting means.

Figure 3:
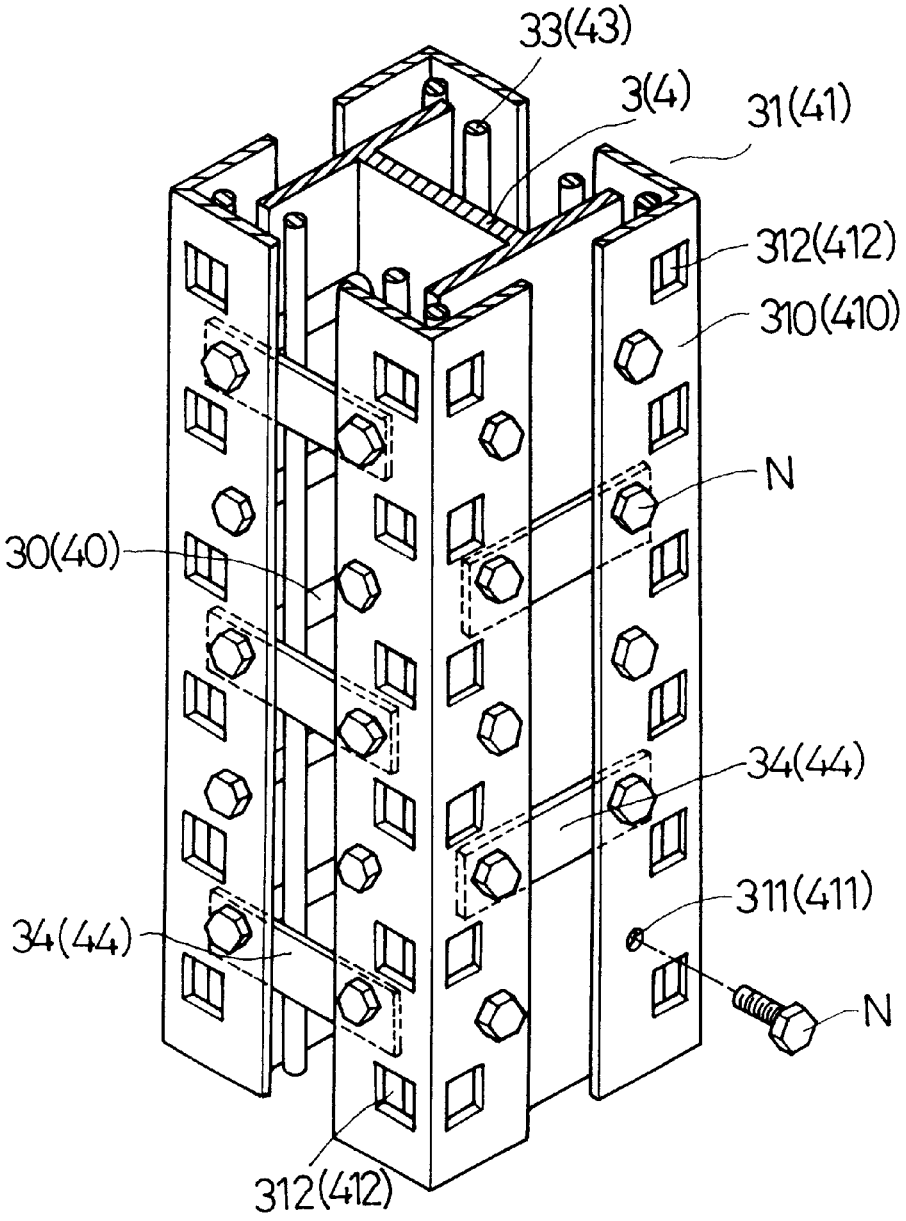
FIG. 3 is a perspective view of an auxiliary structure in the present invention.

Further, the steel frame structure 2 has auxiliary structures 31, 41 for the steel posts 3 and the steel beams 4, as shown in FIG. 3.

The steel frame structure 2 further has plural steel frames 310, 410 positioned to surround corners of each steel post 3 and each steel beam 4. Each steel frame 310,410 has plural holes 311,411 for bolts N to insert through to screw with the connecting means or connecting parts 300, 400 of the connect members 30, 40 so as to secure the steel frame with the steel post 3 or the steel beam 4. Each steel frame 310,410 has plural flow holes 312, 412 spaced apart properly for concrete to flow through. Further, each two neighboring steel frames 310, 410 are connected with connect plates 34, 44. Thus the auxiliary structures 31, 41 are finished.

Figure 3C:
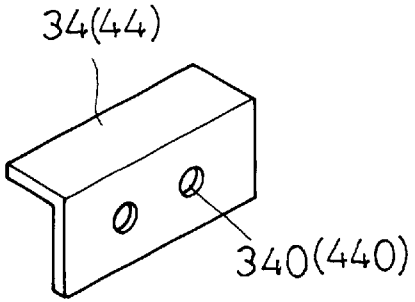
FIGS. 3A, 3B and 3C are perspective views of connectors of the auxiliary structure in the present invention.
Figure 3B:
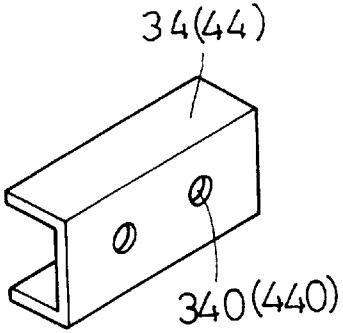
Figure 3A:
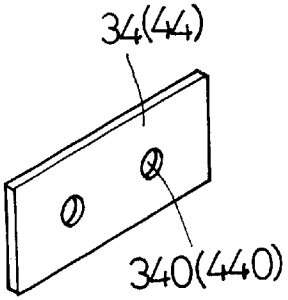

The connect plates 34, connecting each two neighboring steel frames 310, 410 increase not only hardness and strength of the auxiliary structures 31, 41, but also effect of assistance and covering. Further, each connect plate 34, 44 has through holes 340, 440 in line with the connect means 300, 400 and holes 311, 411 of the steel frame 310, 410 for bolts to screw with. The connect plates 34, 44 may be a flat plate, a channel or an angle, referring to FIGS. 3A, 3B, and 3C.

Next, the steel frame building structure also includes a floor structure 5, which has floor steel plates 50 arranged on the surfaces of the steel beams 4, a steel bar net 51 placed on the floor steel plates 50. Fix steel bars 510 are positioned at four sides of the steel bar net 51 for securing the net 51, respectively bending up and down outside the steel beam 4. (The fix steel bars 510 in the first floor bend up only.) Further, the steel frame building structure includes plural connectors 6, which connect to the connect members 40 of the steel beam 4, secured on the steel beam 4 with bolts N. The connector 6 has a L shape and two threaded holes 60 in a bent short portion for bolts to screw with the connect part 400 of the connect members 40, and two connect holes 610 formed in a flat portion 61 to fix with a support frame 70 of the wall structure 7.

Figure 4:
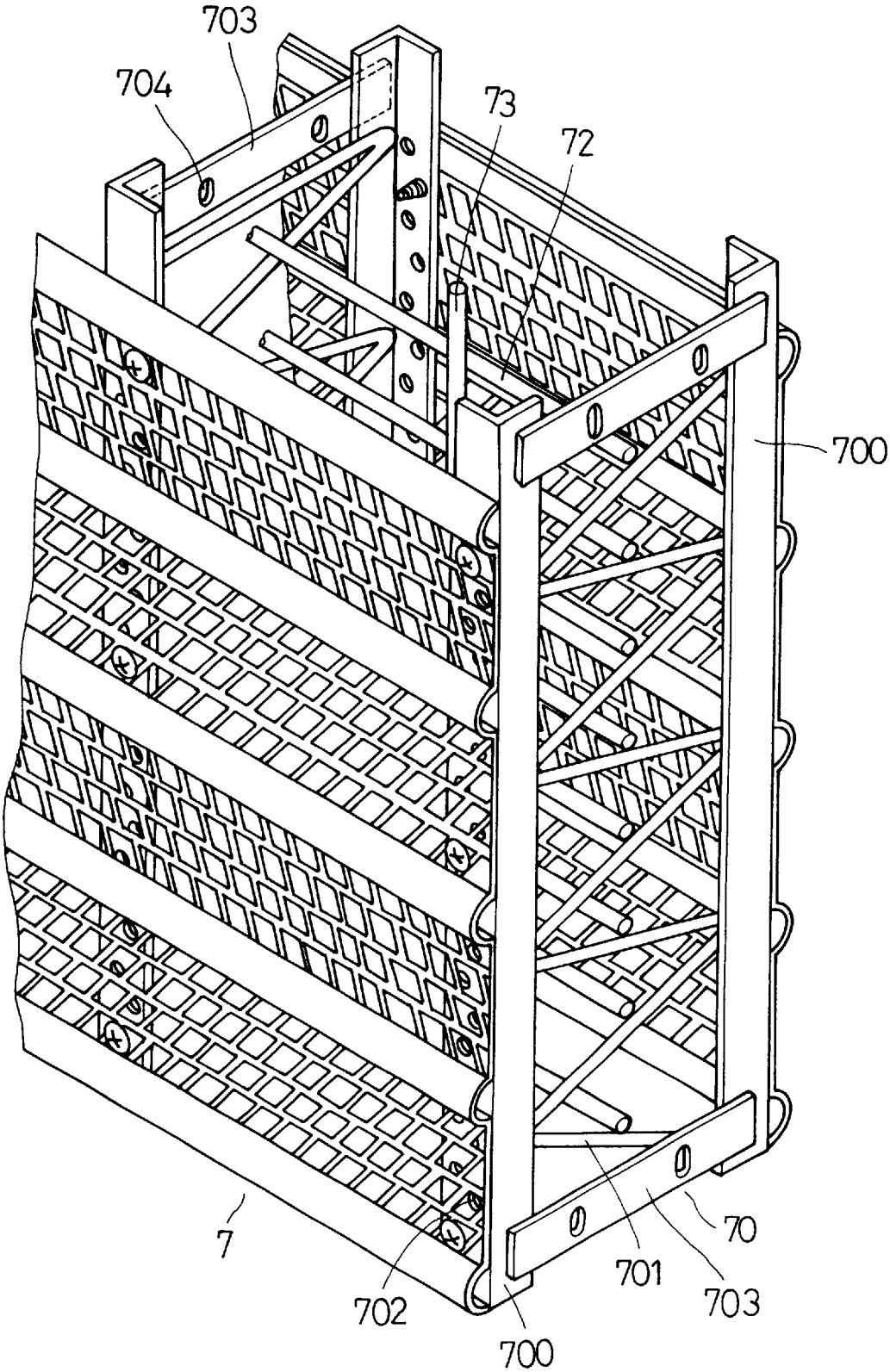
FIG. 4 is a perspective view of a first embodiment of a wall structure in he present invention.

The steel frame building structure further includes the wall structure 7, which is positioned outside of the steel beam 4, having plural support frames 70, as shown in FIGS. 2 and 4, plural lateral bars 72 and plural vertical bars 73 provided between every two support frames 70, a vertical angle 700 located respectively at the corners, plural connect bars 701 connecting two vertical angles 700 in parallel of two opposite sides. Each vertical angle 700 has plural holes 702 on an outer surface. Further, a connect plate is welded on upper ends and lower ends of the two vertical angles 700 in parallel, having two slots 704 spaced apart properly to correspond and connect to the connector 6.

In assembling, firstly the steel posts 3 and the steel beams 4 are assembled with each other at preset locations to form a main frame of the steel frame structure 2, and then the steel frames 310, 410 and the connect plates 34, 44 of the auxiliary structures 31, 41 are combined between the steel posts 3 and the steel beams 4, as shown in FIG. 3. Then the reinforcing steel bars 33, 43 are placed between each structure, and the floor structure 5 (as shown in FIG. 2) is laid on the upper surfaces of the steel beams 4. In other words, the floor plates 50 are arranged on the upper surfaces of the steel beams 4, and the steel bar nets 51 are laid on the floor plates 50. After that the wall structures 7 are combined at the outside of the steel frame structure 2, by combining each support frame 70 with the side of each connector 6. At first the connect plates 703 of the support frames are put together with the flat portions 61 of the connector 6, and then bolts N screw through the opposite holes 610 and the slots 704 of the connect plates 703 to secure them tightly. The slots 704 of the connect plates 703 serves for adjusting any errors in the combined position of the frames. Next, the lateral bars 72 are made to pass through on and welded with the connect bars 701, and also welded with the vertical bars 73 located between every two support frames 70. Then the fix steel bars 510 are lateral bars 72 either with binding wires or with welding. Thus, the outside wall structure is completed.

Figure 5:
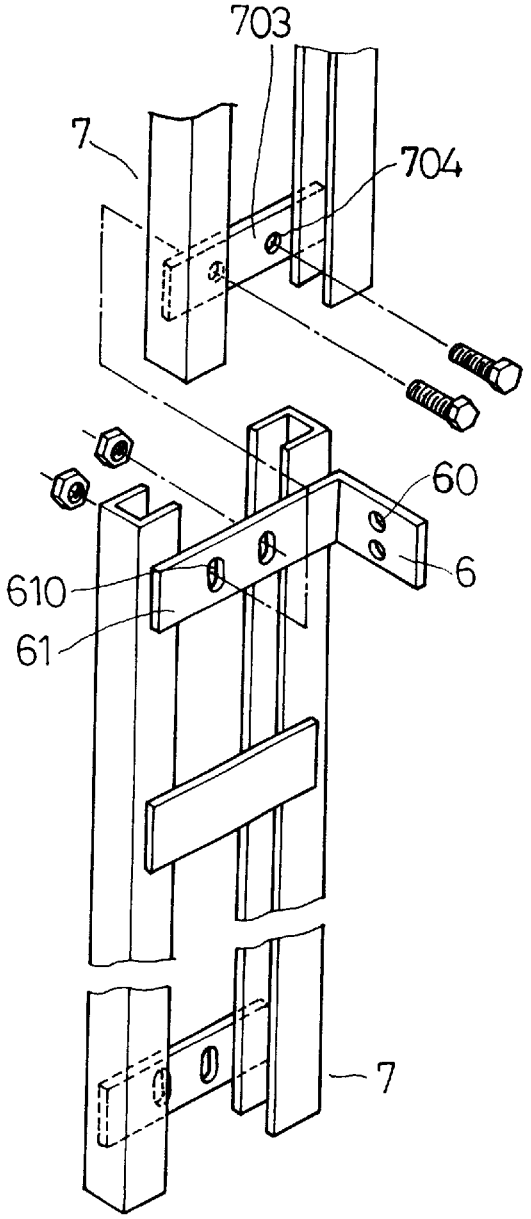
FIG. 5 is a perspective view of a second embodiment of a wall structure in the present invention.

In assembling an upper floor with a lower floor, another method is used, as shown in FIG. 5. The flat portions 61 of the connectors 6 are directly welded with the support frames 70, and also fixed with the steel beams 4 with bolts screwing the threaded holes 60.

Then the support frames 70 of another floor wall structure 7 have the connect plates 703 put together with the flat portions 61 (already fixed with the wall surfaces of the lower floor) of the connectors 6 and secured tightly together with bolts N passing through the connect holes 610 and the slots 704 of the connect plates 703. Thus the upper and the lower floor wall are finished in assembling.

Figure 6:
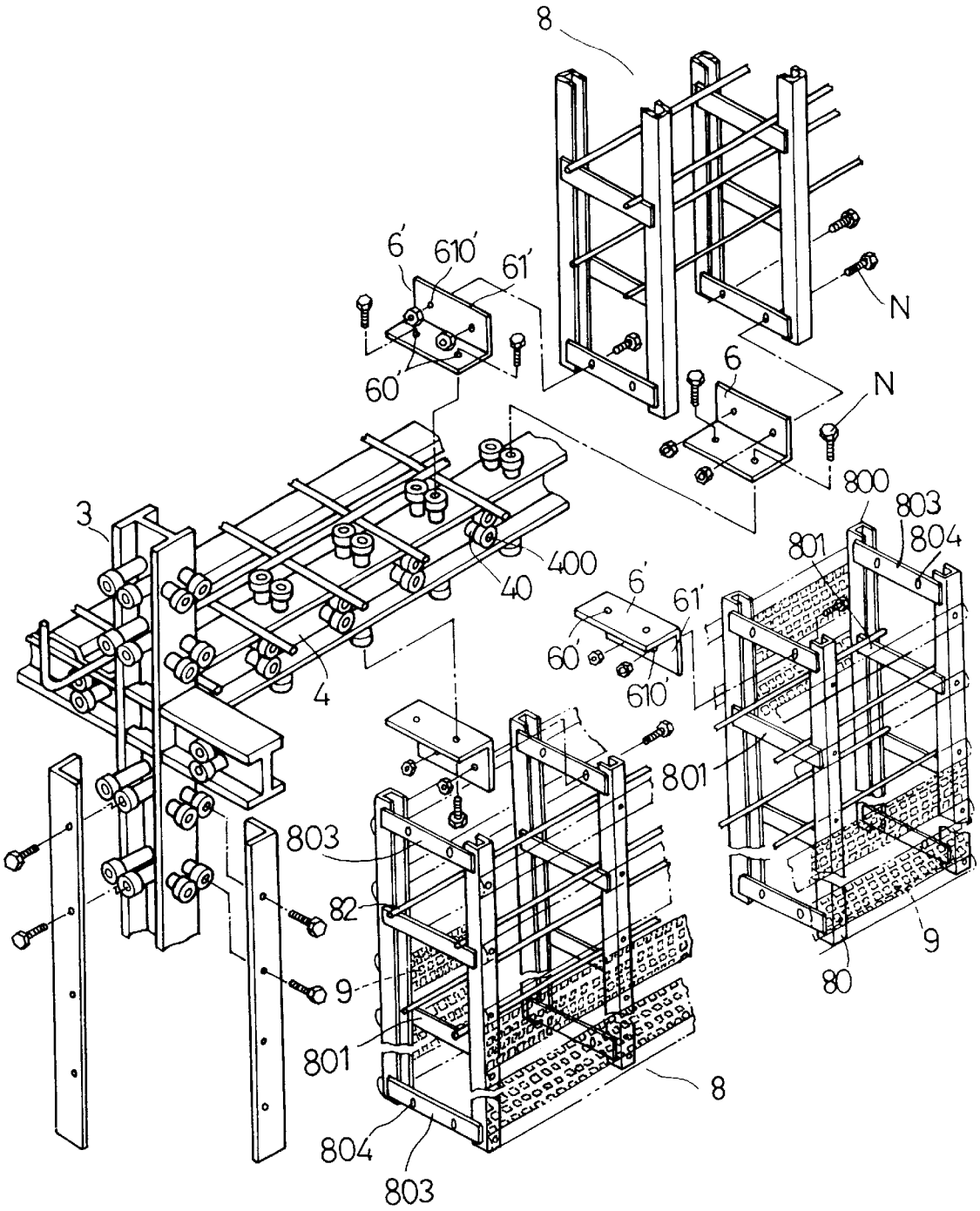
FIG. 6 is a perspective view of a third embodiment of a wall surface in the steel frame building in the present invention.
Figure 8:
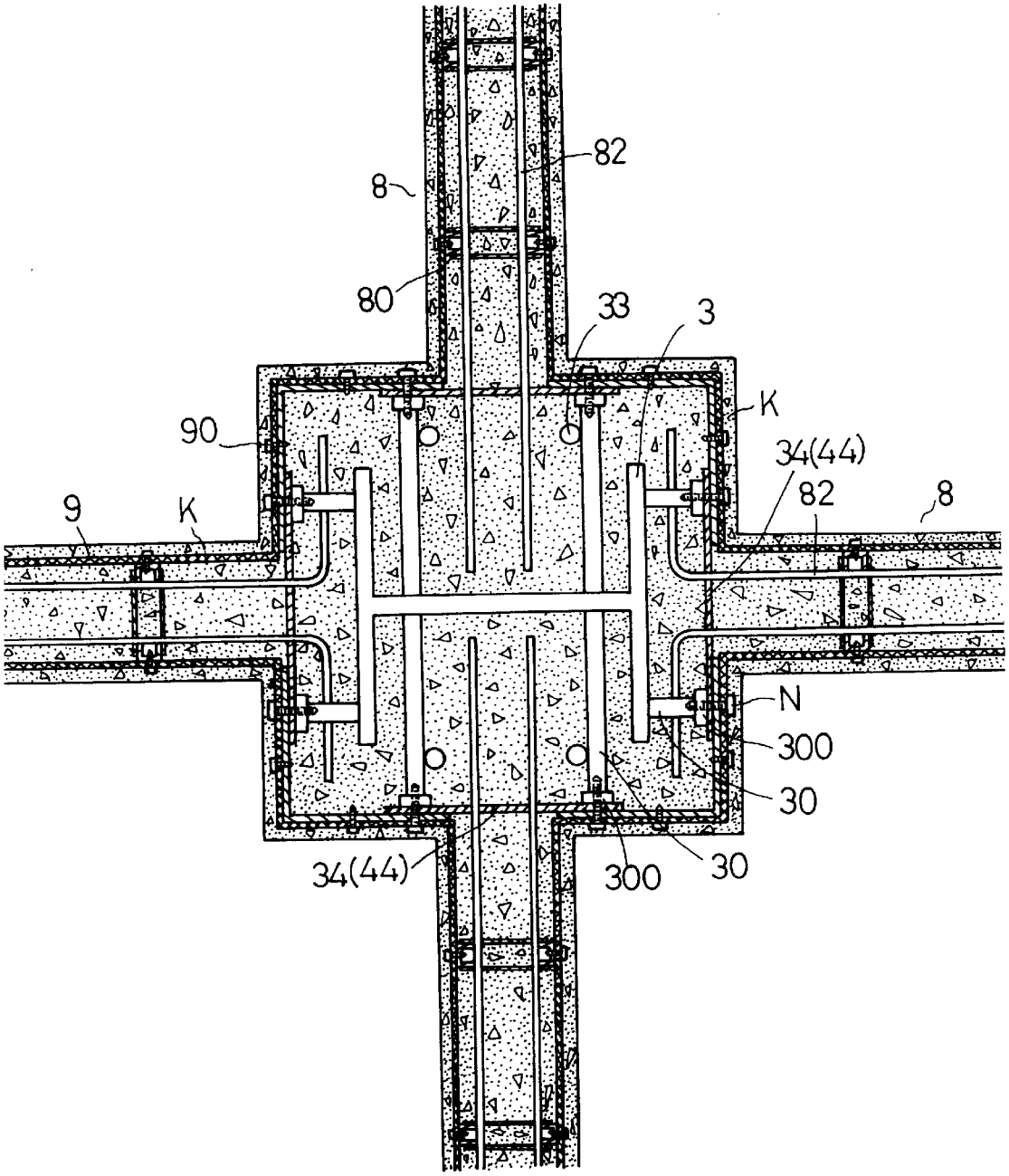
FIG. 8 is a cross-sectional view of a wall post in the steel frame building in the present invention.
Figure 9:
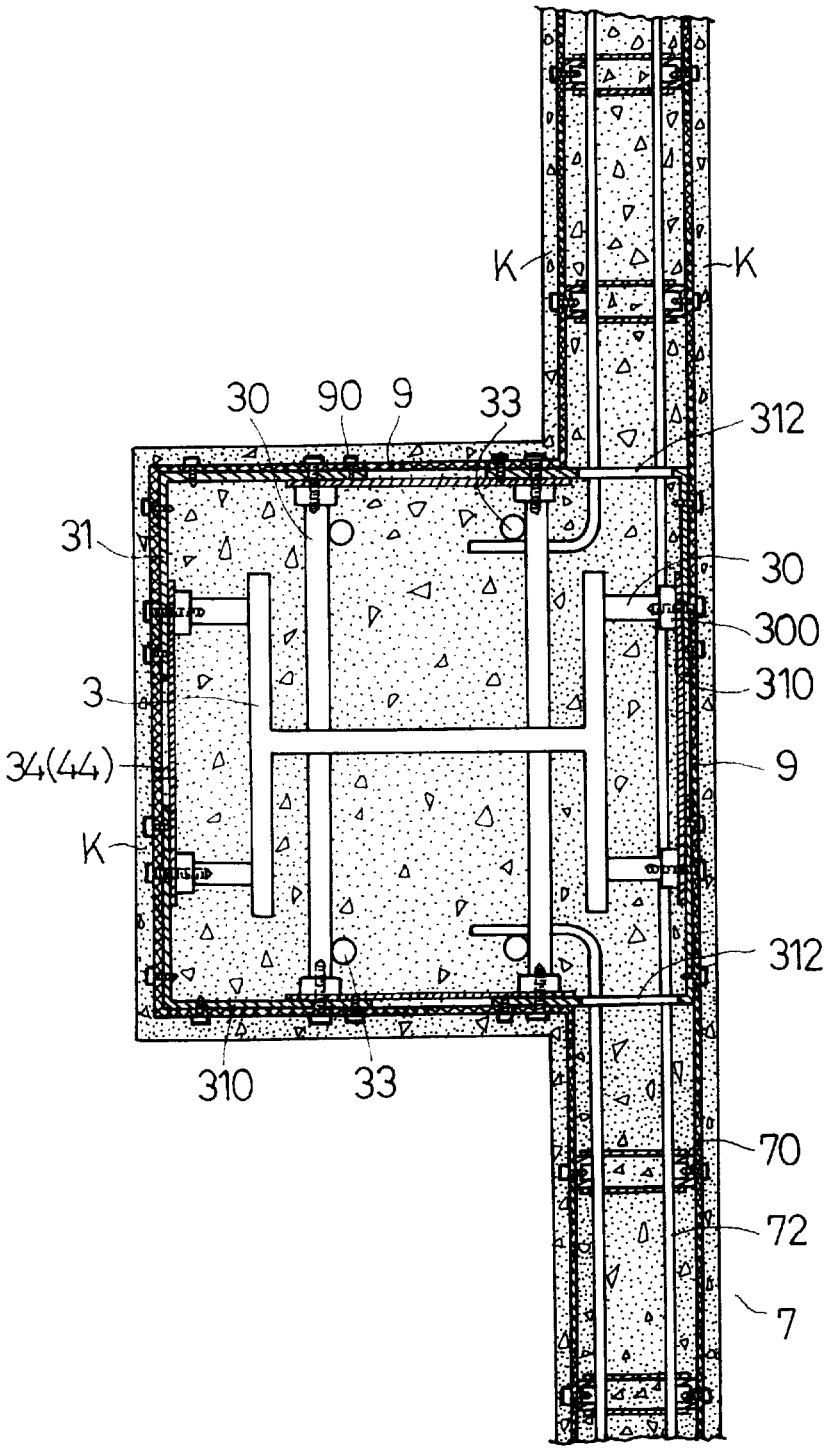
FIG. 9 is another cross-sectional view of a wall post in the steel frame building in the present invention.
Figure 10:
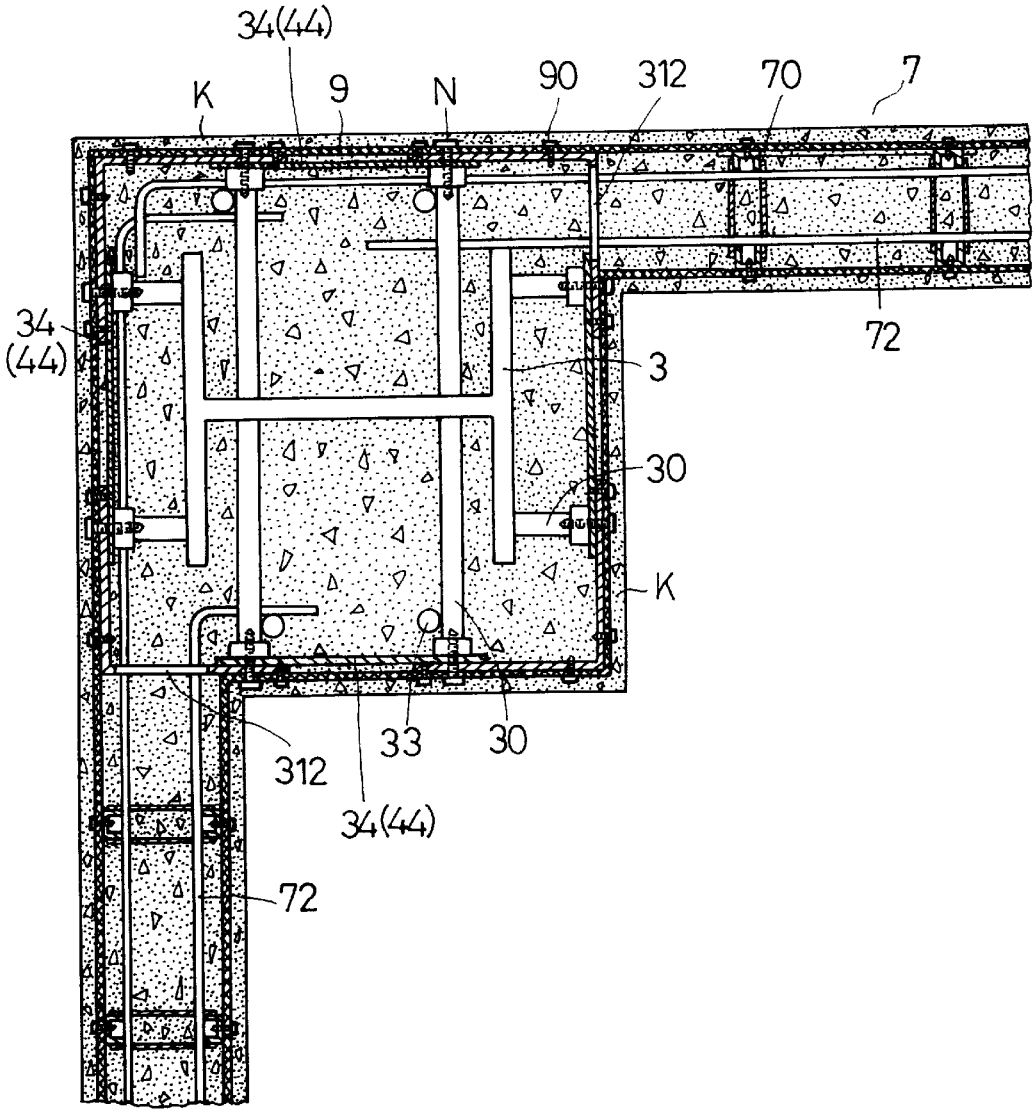
FIG. 10 is another cross-sectional view of a wall post in the steel frame building in the present invention.
Figure 11:
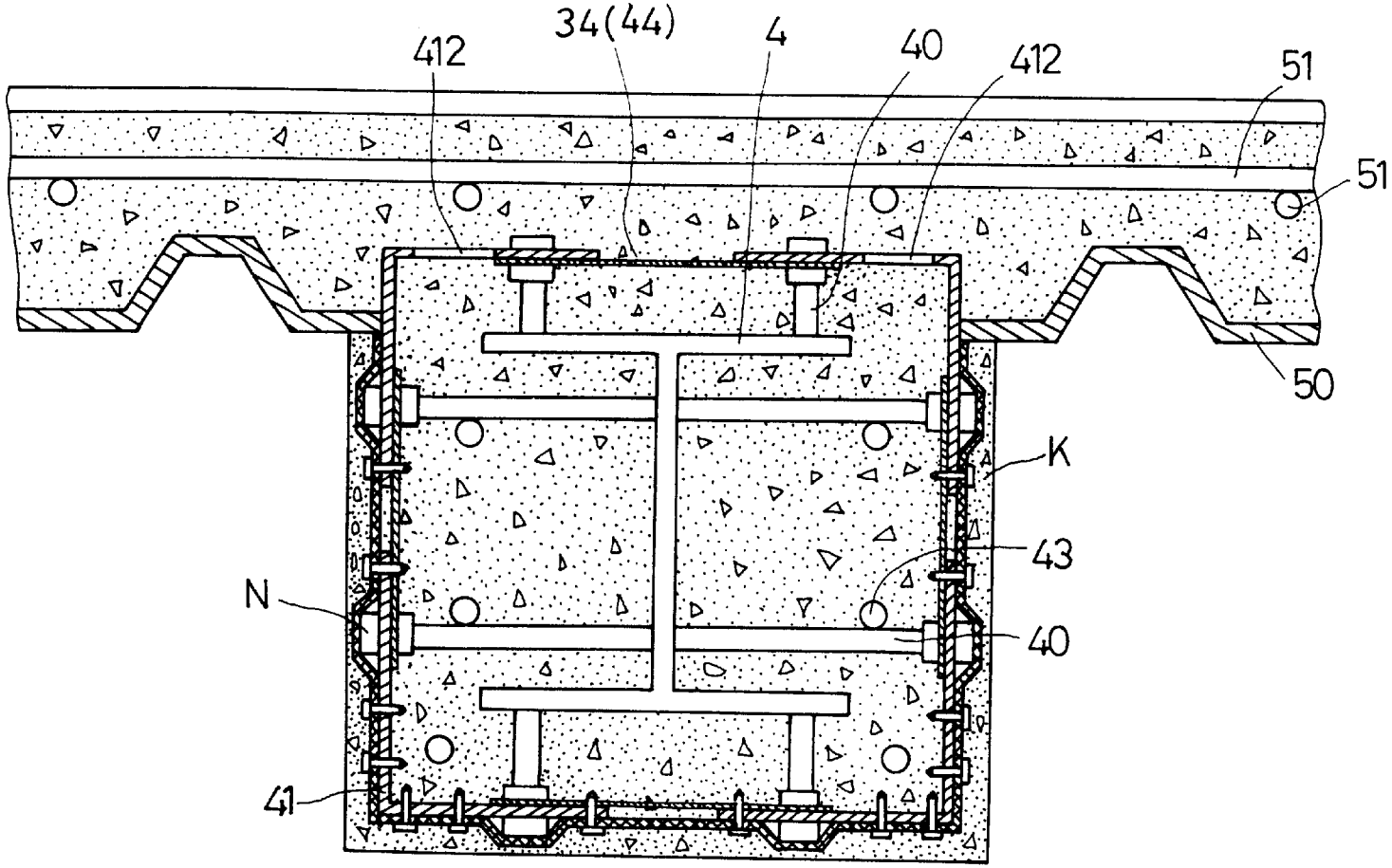
FIG. 11 is a cross-sectional view of a floor and a beam wall combined in the steel frame building in the present invention.

Next, a wall structure 8 for separating rooms inside a building is shown in FIG. 6, positioned on the steel beams 4. This wall structure 8 includes support frames 80 formed with parallel pairs of two vertical channels 800 connected with connect plates 801. Each vertical channel 800 has plural holes 802, and a connect plates 803 is respectively welded with upper ends and lower ends of the two vertical channels of each pair. The connect plate 803 has two slots spaced apart aligned to the opposite holes 610' of the flat portions 61' of the connectors 6'. The connectors 6' is nearly shaped as L, having two threaded holes 60' on its upper flat portion to be connected to the connect parts 400 of the connect members 40, and its vertical portion used as a connect means 61' provided with two holes 610'.

In assembling the wall structure 8, firstly the connectors 6' have its threaded holes 60' aligned to the connect means 400 of he connect members 40 and screw with each other-tightly. Then the connect plates 803 of the support frame 80 are put together with the connect means 61' of the connectors 6', letting the holes 804 face the holes 610', and then bolts N pass through the holes 610' and the slots 804 and screw with nuts tightly. The slots 804 serve for adjusting any errors in the assembling. Next, the lateral steel bars 82 are placed on the connect plates 801 and can be welded with the vertical bars if necessary. Finally holed plates 9 are combined with the holes 802 of the support frames 80, finishing assembling of the wall structure 8.

Figure 7:
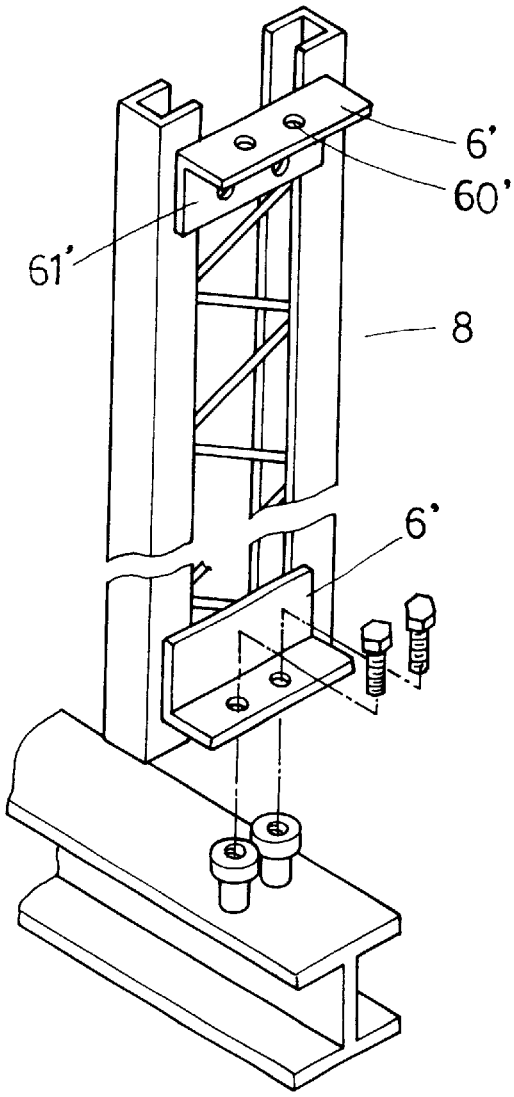
FIG. 7 is a perspective view of a fourth embodiment of a wall structure in a connecting condition in the present invention.

The room separating wall structure between an upper and a lower floor can also be constructed by another method, by welding the connect means 61' of the connector 6' with the support frame of the wall structure 8, as shown in FIG. 7. Next, bolts are used to screw with the threaded holes 60' of the connector 6' and the connect part 400 of the connect member 40 tightly. Thus the wall structure 8 is completed with this method.

Figure 12:
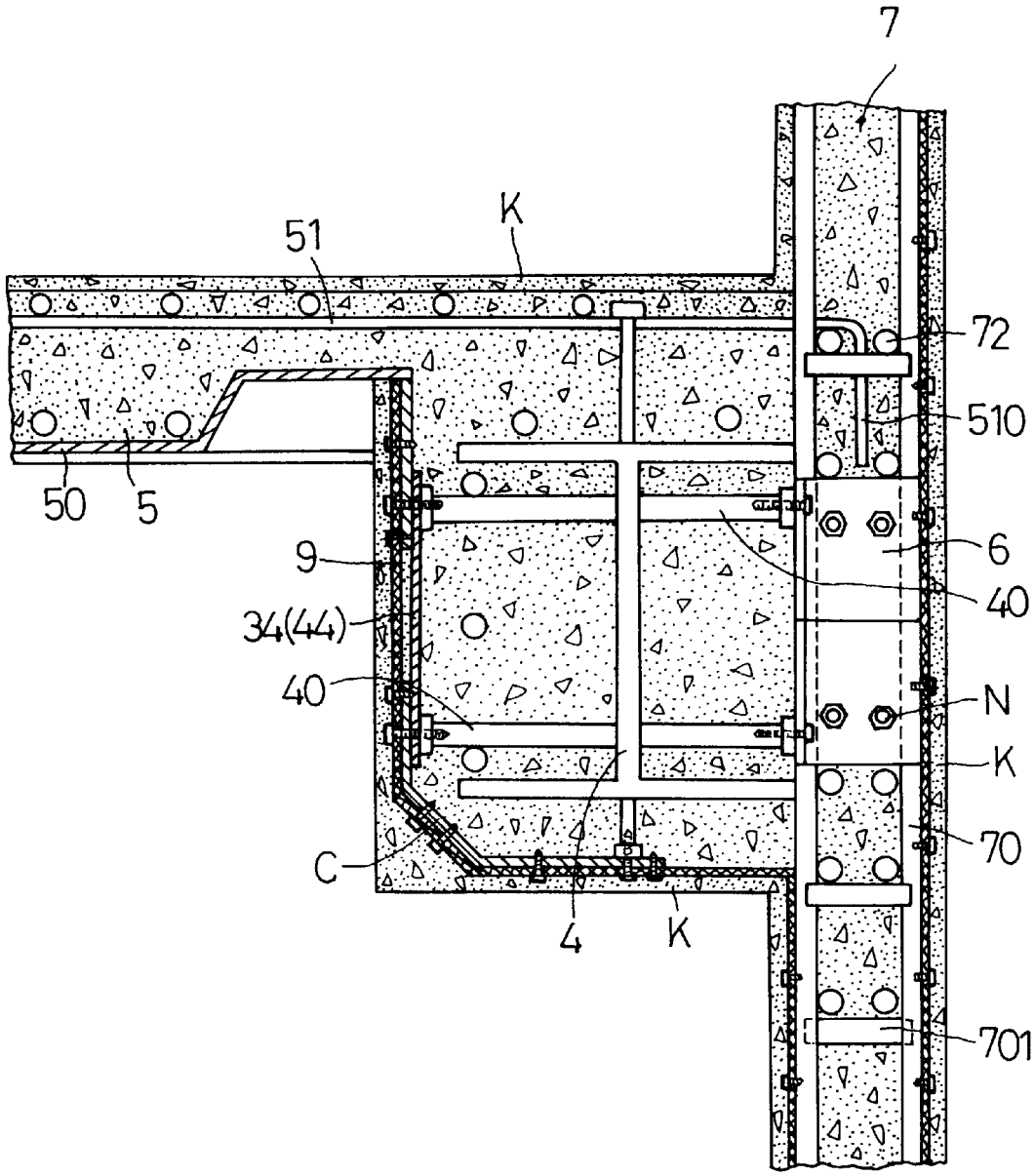
FIG. 12 is another cross-sectional view of a floor and a beam wall combined in the steel frame building in the present invention.

This method of the wall structure 8 can also be applied to outer walls of a building. After the steel posts and the steel beams and the steel frames are assembled together, the holed plates 9 are assembled with the steel frames 310, 410 of the steel posts 3 and the steel beams 4 or with the connect plates 34, 44 and the support frames 70, 80 of the wall structures 7 and 8 by means of sealing means or sealing device 90, as shown in FIGS. 8–12. If steel bars (such as lateral bars or reinforcing bars) in these structures are to be hampered by posts or beams, they are bent to extend in another structure to secure and reinforce one another. Further, the holed plates 9 may be replaced with steel net galvanized with tin, in order to enhance toughness of the whole structure, not letting concrete inside the net rupture or explode and concrete surfaces appear few cracks. Further it may be used as outer concrete form plates, getting rid of troublesome work of making concrete form plates. After the outer steel net is sealed, concrete can be placed through the pour holes preset in the structure and then through the flow holes 312, 412. The steel frames 410 have a sloped guide corner surface C as shown in FIG. 12, permitting placed-in concrete to move smoothly into the floor, around the steel posts 3, the steel beams 4, etc. Then after concrete hardens, concrete tightly surrounds the steel posts 3, the steel beams 4, the steel bars 510, the steel frames 310, 410, etc., reinforcing toughness and structural strength of the whole structure.

After a building is finished in its steel posts, steel beams and walls, grouting cement is used to coat the surfaces of all the walls (as shown in FIG. 8–12, coated with it) and smoothed with a sleeker. Wall surfaces formed in this invention do not have rough surfaces comparatively flat so easier to smooth them than those made by conventional methods.

The invention has the following advantages, as understood from the aforesaid description.

1. The connecting means, the auxiliary support frames for the steel posts and the steel beams, the wall structure support frames and holed plates can all be made in a factory, so constructing is fast, finished quality stable, efficiency high, and even attain a target of automotive production. Under normal condition, this invention can save a half or two thirds of time needed in construction, lessening much interest of expenditure.

2. Connect means are welded with channels and angles with nails, and the steel posts, the steel beams, and the support frames of the wall structure are screwed tightly together with bolts and nuts. Concrete is combined with the channels and the angles, and surrounding the auxiliary structures of the steel posts and the steel beams, and combining the wall structures with the steel posts and the steel beams completely as well. Thus, the invention improves a drawback of the steel frame and steel bars combined with concrete in an inferior condition, enhancing earthquake resisting force at the same time.

3. The holed plates take place of concrete forms, and the net sealers connected with the support frames and the frame channels tightly, connecting those together. Further, the holed plates have high toughness, constricting concrete inside the holed plates not to explode or broken to pieces in case of earthquakes or collision.

4. The auxiliary structures surrounding the steel posts and the steel beams and the wall structures are made of channels or support frames with lateral bars. So they can be automatically produced, quick to be constructed with good quality, its whole strength being better than those made by conventional methods of binding steel bars.

5. As the holed plates take place of concrete forms, tubes set in the steel posts and the walls are visible from outside, without fear of breaking tubes in binding concrete forms on steel posts. Any hole can be made or preset in advance in the holed plates for placing concrete in, and it is clear to see if there are any bee hive condition in concrete, possible to control concrete placing work.

6. As the holed plates take place of concrete forms, they are easy to set, and no wood bits of concrete forms or miscellaneous matters may mix into concrete to degrade concrete quality, needing no support means, binding strings, or hanging rods, or other auxiliary tools. Then space for constructing work becomes wide, and wide space is not needed to store concrete forms, possible to keep the constructing site clean. in addition, no wood is wasted to make concrete forms.

7. The design idea of the invention includes steel frames and lateral style support frames as main components and steel bars and concrete as auxiliary components, and construction is mainly performed in a factory, assembling and concrete placing only are performed at a constructing site. Its constructing structure also includes bolts and various connect means for securing support frames and holed plates, so connection is reliable, and it can reduce constructing points and needed workers, resulting in easy management and better and safe quality.

8. As the holed plates take place of concrete forms, air bubbles caused by concrete placing can escape out from the holes in the holed plates, and concrete may become solid by lightly patting. At the same time concrete may fill up the holes of the holed plates, not causing bee hive condition often occurring in conventional methods, or water does not floats on surfaces of concrete, with no troublesome work of taking off concrete forms after concrete hardens. In addition, concrete wall surfaces may be comparatively flat to be easily smoothed by workers. Grouting cement on the surfaces is securely maintained by the rough surfaces of the holed plates, without causing cracks, crevices or cleft in wall surfaces.

9. When walls are made outside of an upper and a lower floor structure, the wall structure is secured with the floor plates by means of the fix steel bars of the floor plates, and the connectors are connected with the steel frame structure with connect means, permitting the wall structure form support walls, and light concrete may be placed in the holed plates of the room separating wall structure, in order to lighten load of material.

10. Tubular routes (PVC tubes) buried in walls may not crack in case of earthquakes or strong sunlight, even if the walls at two sides of the tubular routes might be very thin, protected by the holed plates outside of the wall surfaces.

11. Concrete placing can be performed after the whole wall structures of a building is completed, so workers can accomplish all concrete placing work at once, without necessity of some workers waiting for finishing one wall structure for concrete placing in conventional methods, wasting time.

12. Arranging water and electrical tubes can be performed after each support frame is finished, needing no molds for connecting, inserting and cases. In addition, water and electric tubes can be checked from outside as the holed plates have holes for look through, and tested if water can flow without leak or not before placing concrete, and repaired or corrected in time if any leak is found.

While the preferred embodiment of the invention has been described above, it will be recognized and understood that various modifications may be made therein and the appended claims are intended to cover all such modifications which may fall within the spirit and scope of the invention.

What is claimed is:

1. A steel frame building structure comprising:

a steel frame structure comprising a main steel frame made of steel posts and steel beams, at least one of said steel posts and steel beams fixed with plural connect members on its surface, an auxiliary structure surrounding a corner of each of said steel posts and each of said steel beams and a plurality of support channel frames and reinforcing steel bars, some of said support channels having flow holes bored in surfaces thereof;

a floor steel structure laid on upper surfaces of said steel beams, comprising plural floor steel plates, and steel bar nets arranged on said floor steel plates;

a main connect portion;

plural connectors connected to the surface of each said steel beam, each said connector having a side bent portion bored with threaded holes to face a connect member of said steel beam for bolts and nuts to screw with said steel beam and a main connect portion bent to extend outward;

plural wall structures respectively connected with the connect members of said steel beams with said connectors;

holed plates comprised of concrete fixed on outer peripheral sides of steel material structures of said steel frame structures; said support channels respectively having flow holes to permit flowing concrete to flow in said structures of said floor, each wall post, each wall beam, each steel post, each steel beam, and said holed plates tightly surrounding said concrete in said steel frame structures so that the whole frame building structure may become integral and be strengthened to improve its structural strength and resist forces from earthquakes.

2. The steel frame building structure as claimed in claim 1, wherein said steel posts and said steel beams having their surfaces fixed with a plurality of said connect members, each said connect member having one end extending outward to form a connect part.

3. The steel frame building structure as claimed in claim 1, wherein said support channels of said auxiliary structure have their inner walls connected with connect plates.

4. The steel frame building structure as claimed in claim 3, wherein said connect plates provided between said inner walls of said support channels are formed from any one of flat, channel, and angle shape, respectively having through holes in two sides for bolts to pass through and screw with said support channels and said steel posts.

5. The steel frame building structure as claimed in claim 1, wherein each said support angle of said auxiliary structure is located at each corner of each said steel post, having plural through holes to correspond to said connect members and connected with said connect parts.

6. The steel frame building structure as claimed in claim 1, wherein said steel bar net of said floor steel structure has a fixed steel bar having two ends bent upward or downward at peripheral sides, and said fixed steel bars of a lowest floor having two ends bent only upward.

7. The steel frame building structure as claimed in claim 1, wherein said connect part of each said connector has connect holes.

8. The steel frame building structure as claimed in claim 1, wherein wall structure comprises plural support frames, said support frames connected with a lateral bar frame between each said support frame having plural lateral and vertical steel bars with interior and vertical angles of each said support frame having their lower and upper ends connected with connect plates bored with through holes to face said connect part of said connector and connect holes in said connect part.

9. The steel frame building structure as claimed in claim 8, wherein said connectors of said wall structure have two slots spaced apart, said slots for adjusting any errors in the position of said wall structure.

10. The steel frame building structure as claimed in claim 1, further comprising a room separating wall structure that is connected with said beams by connectors of nearly L-shape with a horizontal portion provided with threaded holes to engage said connect parts of said connect members and a vertical portion bored with through holes to face said connectors with holes at the upper portion of said wall structure.

11. The steel frame building structure as claimed in claim 1 wherein said holed plates are fixed with said support frames with net sealing means, utilizing steel nets that are tin-galvanized to increase toughness of said steel frame building structure, thereby preventing concrete inside said nets to explode or rupture or wall surfaces to produce cracks, said holed plates interchangeable with outer concrete forms.

12. The steel frame building structure as claimed in claim 1, wherein said connectors each have a connect device directly welded with said support frames and screwed tightly with said connect members of said steel posts with bolts.

* * * * *